United States Patent [19]

Yamada et al.

[11] Patent Number: 4,496,312

[45] Date of Patent: Jan. 29, 1985

[54] HEAT-TREATMENT SYSTEM AND PROCESS

[75] Inventors: Shunsuke Yamada; Kenji Kawate; Takashi Ono; Hideo Arakawa; Tsuyoshi Suda, all of Aichi, Japan

[73] Assignee: Daidotokushuko Kabushikikaisha, Japan

[21] Appl. No.: 502,779

[22] Filed: Jun. 1, 1983

[30] Foreign Application Priority Data

Jun. 9, 1982 [JP] Japan ..... 57-99075

[51] Int. Cl.[3] ..... F27D 3/00; F27B 9/16; F27B 9/02

[52] U.S. Cl. ..... 432/11; 266/249; 432/18; 432/128; 432/138

[58] Field of Search ..... 432/11, 18, 128, 138; 266/249

[56] References Cited

U.S. PATENT DOCUMENTS 3,079,135 2/1963 Buckholdt ..... 432/138

4,406,618 9/1983 Maeyama ..... 432/138

4,412,813 11/1983 Wulf ..... 432/138

FOREIGN PATENT DOCUMENTS 550436 10/1975 U.S.S.R. ..... 432/138

*Primary Examiner*—John J. Camby

*Attorney, Agent, or Firm*—William A. Drucker

[57] ABSTRACT

Inside a furnace body a number of material-stay spaces are set along a predetermined circular locus of travel of materials to be treated. The furnace body is divided into a heating chamber and a cooling chamber, and some of the stay spaces are located in the former chamber while the others are in the latter. A material is placed into one of the stay spaces located in the heating chamber, and heated therein. Then the material is moved into and stopped at one of the stay spaces located in the cooling chamber, and cooled therein. This process of heating and cooling the material is repeated a predetermined number of times so as to treat the material as desired.

6 Claims, 9 Drawing Figures time
material-stay space
11a
11e
11b
11f
11c
11g
11d
area 20₁
area 20₄
area 20₇
area 20₃
area 20₆
area 20₂
area 20₅
in
out
empty
rotation
repeated
rot.

temperature (°c)
20
700
750
700
745
700
740
700
650
100 ~ 200
preheating chamber 46
material-stay space 11a 11e 11b 11f 11c 11g
cooling chamber 65

HEAT-TREATMENT SYSTEM AND PROCESS

BACKGROUND OF THE INVENTION

1. Field of the Invention

This invention relates to systems for heat-treating metal materials such as steel or other kinds of materials by repeating alternate treatments of heating and cooling the material a number of times, and a process for heat-treating the materials of the kinds stated by using the above-mentioned systems.

2. Description of the Prior Art

One of the conventional types of heat-treatment systems as stated above includes a number of heating chambers and cooling chambers arranged so as to alternate with the other ones along the direction in which to convey the material to be treated. In such a construction it is no small trouble to keep each treatment chamber in a good state of repair.

SUMMARY OF THE INVENTION

An object of the invention is to provide a heat-treatment system including no more than one heating chamber and one cooling chamber, thereby making the whole maintenance of the system a simpler work.

Another object of the invention is to provide a heat-treatment system including no more than one heating chamber and one cooling chamber, but making it possible to alternately heat and cool the material a number of times, and a process for such a heat treatment.

Other objects and advantages of the invention will become apparent during the following discussion of the accompanying drawings.

DESCRIPTION OF THE PREFERRED EMBODIMENTS

Figure 1:
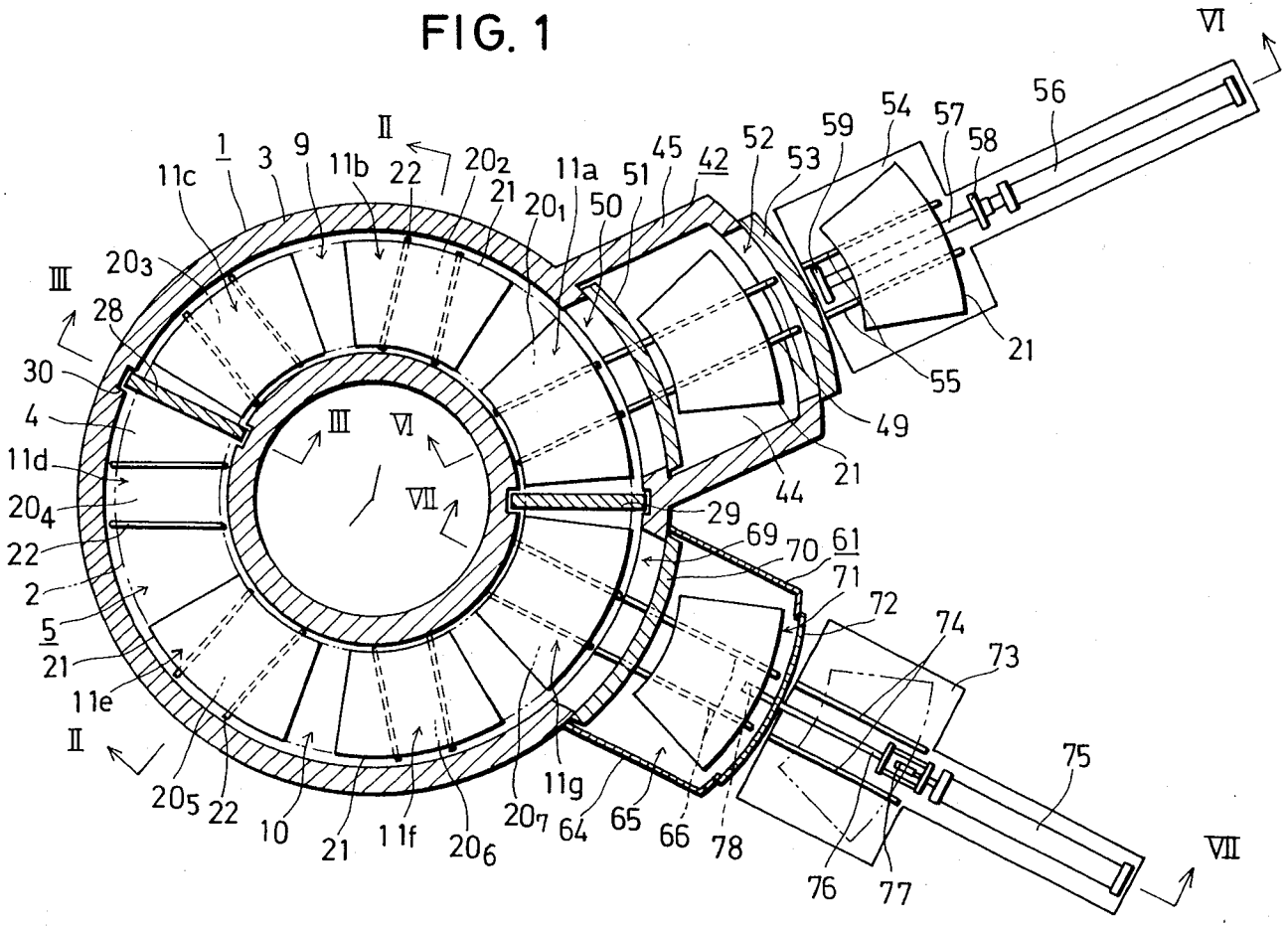
FIG. 1 is a horizontal sectional view of one embodiment of the invention.
Figure 2:
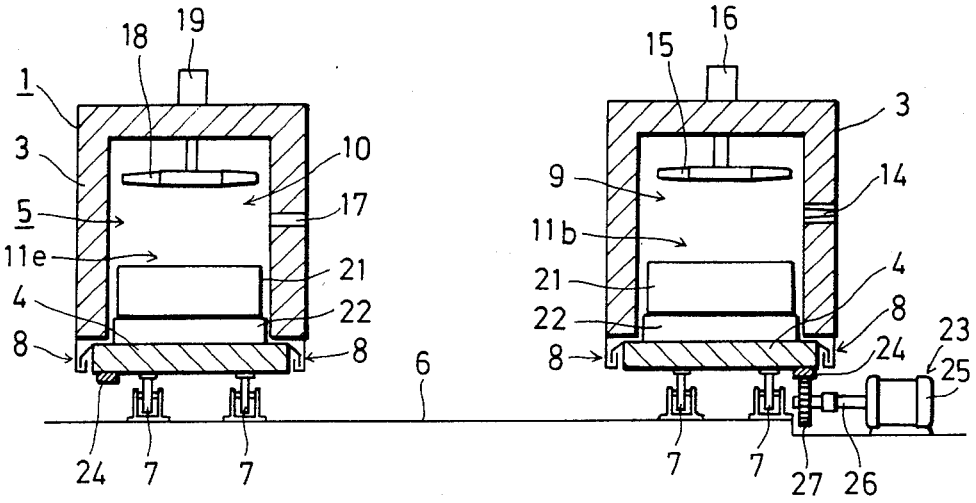
FIG. 2 is an enlarged cross section taken on the line II—II of FIG. 1.

Referring to FIGS. 1 to 7, an annular furnace body 1 is constructed of an enclosure 3 and a hearth 4, and includes a circular heat-treatment space 5 in which there is set a travel locus 2 to be generated by the materials (to be treated) when they are circulated (as described herein after). The enclosure 3 is fixed to a floor 6 by support means (not shown). The hearth 4 is adapted to rotate along the material-travel locus 2 by means of a number of operating wheels 7. Both enclosure 3 and hearth 4 are so constructed as to minimize a heat loss from the treatment space 5. Between the hearth 4 and the enclosure 3 are provided sealing means 8 well-known in the art for keeping gases within the treatment space 5 from escaping.

The treatment space 5 is divided into a heating chamber 9 and a cooling chamber 10 separated from each other by doors 28 and 29 (hereafter described) and arranged along the travel locus 2. Through the entire treatment space 5 are set spaces 11*a*, 11*b*, 11*c*, 11*d*, 11*e*, 11*f*, and 11*g* which are circularly spaced apart from one another at equal intervals and in which to stay the materials for treatment. These stay spaces 11*a* to 11*g* are also arranged along the material-travel locus 2. The number of the stay spaces 11*a* to 11*g* is set at the sum of twice the number of heat treatments to be made for the material (one treatment to consist of a whole process of heating and cooling) and 1 (one). For example, a whole process of heating and cooling the material is to be repeated three times in the particular embodiment herein; therefore, the number of the stay spaces 11*a* to 11*g* is set at 7 (seven) in this embodiment. The stay spaces 11*a*, 11*b*, and 11*c* are located in the heating chamber 9, while the other stay spaces 11*e*, 11*f*, and 11*g* are located in the cooling chamber 10. Although the stay space 11*d* is in the cooling chamber 10 in the embodiment herein, however, it may be located in the other chamber 9 by disposing the partition door 28 between the stay spaces 11*d* and 11*e* instead of 11*c* and 11*d*, or it also may be located in a place not belonging to the chambers 9 nor 10 by disposing another door between the spaces 11*d* and 11*e*, in addition to those 28 and 29. The section of the furnace enclosure 3 defining the heating chamber 9 is provided with a heating means 14 such as a burner or electrothermal means. Also, an air circulator 15 such as a fan is connected to the same section in conjunction with a motor 16 for operating the air circulator 15. On the other hand, the section of the furnace enclosure 3 defining the cooling chamber 10 is provided with a cooling means 17 such as an opening for supplying a cooling medium into the chamber 10 and a combination of air circulator 18 (such as a fan) and motor 19 for operating the air circulator 18. Generally, the cooling medium to be supplied through the opening 17 may be air. The furnace enclosure 3 is also provided with an outlet (not shown) for discharging the air supplied into the cooling space 10.

On the upper surface of the movable hearth 4 are set or determined areas $20_1$, $20_2$, $20_3$, $20_4$, $20_5$, $20_6$, and $20_7$ which are provided in the same number as the material-stay spaces 11*a* to 11*g* and spaced apart from one another at the same intervals as the stay spaces and on which to place baskets 21 containing materials to be treated. These material places $20_1$ to $20_2$ each are provided with a pair of rails 22 on which to locate the baskets 21.

On the floor 6 is located a means 23 for rotating the hearth 4 which comprises a rack 24 connected to the hearth 4 at the entire outer edge of the lower surface thereof, a motor 25 disposed on the floor 6 and having a shaft 26, and a gear 27 connected to the shaft 26 and meshing with the rack 24. When the motor 25 is operated, therefore, the hearth 4 rotates along the material-travel locus 2.

Figure 3:
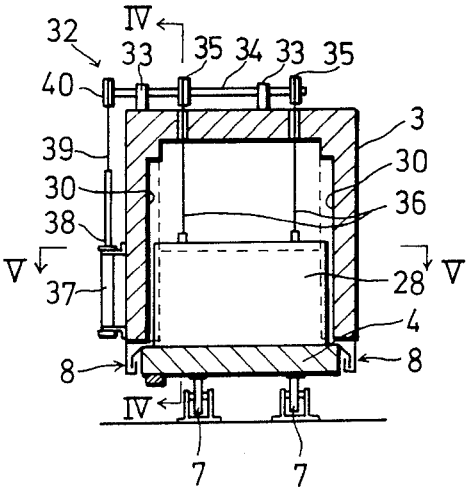
FIG. 3 is an enlarged cross section taken on the line III—III of FIG. 1.
Figure 4:
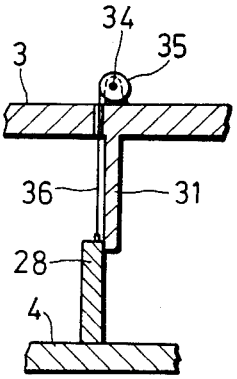
FIG. 4 is a cross section taken on the line IV—IV of FIG. 3.
Figure 5:
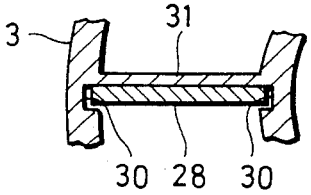
FIG. 5 is a cross section taken on the line V—V of FIG. 3.

Referring to FIGS. 3 and 5 in particular, the partition door 28 can be moved in vertical directions along and between a pair of grooves 30 which are oppositely provided in the inner surfaces of the inner and outer walls of the furnace enclosure 3, respectively. A partition wall 31 projects downward from the top of the enclosure 3 into the treatment space 5 and in a position adjacent to that of the door 28 when the door 28 is raised (FIG. 4). As clearly shown in FIG. 4, the partition wall 31 only extends halfway, but completely separates the two treatment chambers 9 and 10 from each other, together with the door 28, when the door 28 is in its lowered position. To the outer surface of the enclosure 3 is connected a mechanism 32 for raising or lowering the door 28, which mechanism 32 includes a drive shaft 34 supported by bearings 33 connected to the top of the enclosure and a cylinder 37 connected to the outer surface of the outer wall of the enclosure 3. The drive shaft 34 has three sprocket wheels 35 and 40, and chains 36 are fitted onto the sprocket wheels 35, respectively, at their upper ends while the chains 36 are connected to the top of the door 28 at their lower ends. The cylinder 37 has a piston rod 38, and a chain 39 is connected to the piston rod 38 at its lower end and fitted onto the outermost sprocket wheel 40 of the drive shaft 34 at its upper end. In this mechanism 32, when the piston rod 38 is operated, the drive shaft 34 is rotated to raise or lower the door 28. The other partition door 29 is also adapted to rise or lower by the same mechanism as for the door 28.

Figure 6:
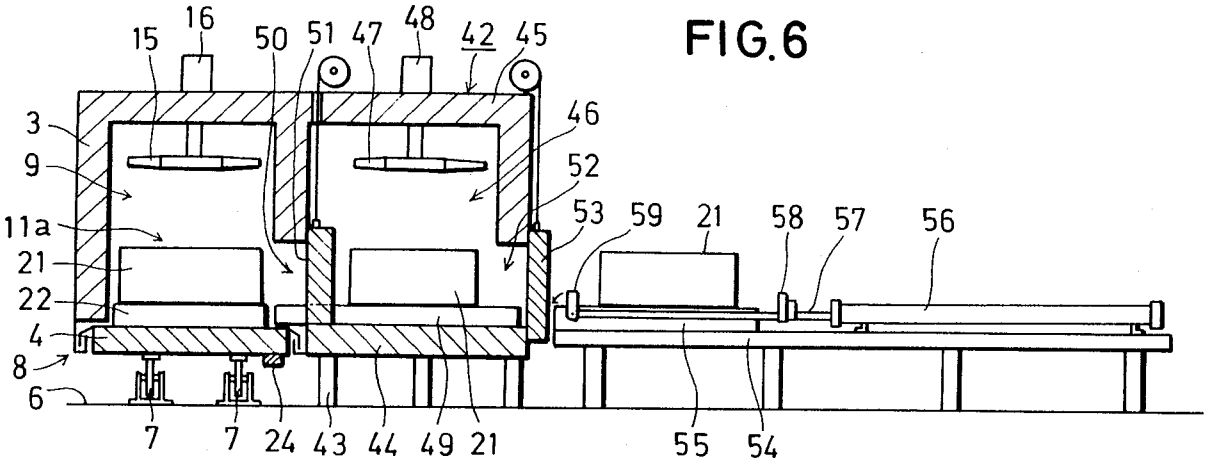
FIG. 6 is an enlarged cross section taken on the line VI—VI of FIG. 1.

Referring to FIGS. 1 and 6, a preheater device 42 is connected to the furnace body 1. The preheater device 42 includes a preheating chamber 46 defined by a furnace body 45 and a hearth 44 fixed to the floor 6 by supports 43. As with the furnace body 1, both hearth 44 and furnace body 45 are so constructed as to minimize a heat loss from the preheating chamber 46. The preheater device 42 is provided with a heating means (not shown), fan 47, and motor 48 similar to those of the heating chamber 9. A pair of rails 49 are located on the hearth 44. As shown in FIG. 1, the preheater device 42 is connected to a portion of the heating chamber 9 of the furnace body 1, and as shown in FIG. 6, that portion or a portion of the outer wall of the chamber 9 has an opening 50 at its lower end. This opening 50 is closed by a movable partition door 51 which is raised to move a basket from the preheating chamber 46 to the heating chamber 9, allowing the former chamber 46 to communicate with the latter 9. The mechanism to raise or lower the door 51 is similar to that for the door 28 or 29. Also, all other similar doors that will be described hereinafter are operated by similar mechanisms. Corresponding to the opening 50, another opening 52 is oppositely provided in the preheater device 42. Similarly, this opening 52 is closed by a door 53, but is opened to move a basket 21 from outside into the chamber 46 by raising the door 53. A table 54 for supplying baskets 21 (containing materials to be treated) into the preheater device 42 is located outside the device 42 in close proximity to the opening 52 of the device 42. On the table 54 are provided a pair of rails 55 on which to place a basket 21 and a cylinder 56 for moving the basket 21. The cylinder 56 has a piston rod 57 with a pair of pushers 58 and 59. In this mechanism, when the cylinder 56 is operated, the piston 57 is moved forward with the pusher 58 moving the basket 21 placed on the table 54 into the preheater device 42 and with another pusher 59 moving the basket 21 in the device 42 (i.e., one previously loaded into the device 21) into the material-stay space 11*a* of the heating chamber 9. When the piston rod 57 is retracted, the forward pusher 59 is brought down in a direction indicated by an arrow in FIG. 6, and allowed to move back under the basket 21 loaded into the preheater device 42.

Figure 7:
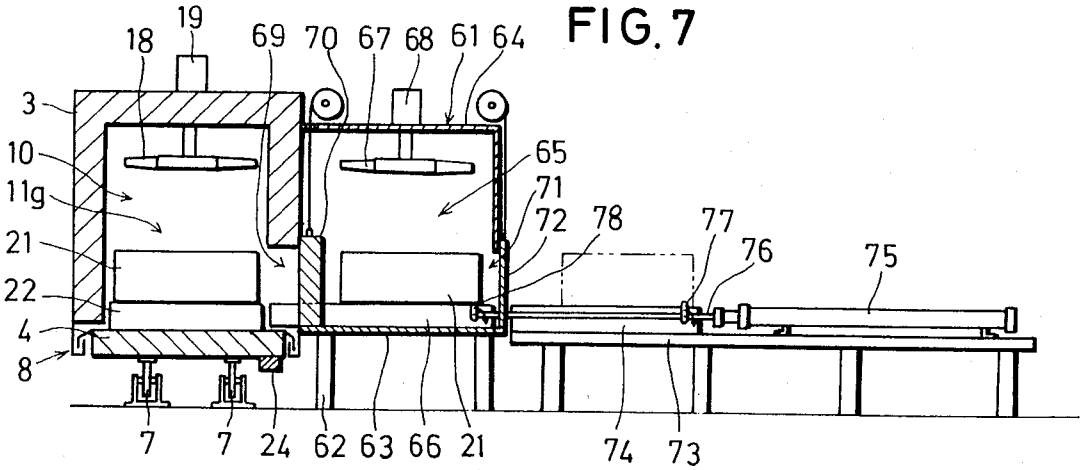
FIG. 7 is an enlarged cross section taken on the line VII—VII of FIG. 1.

Also, a cooler device 61 is connected to the furnace body 1 (FIGS. 1 and 7). The cooler device 61 includes a cooling chamber 65 defined by a cooler body 64 and a cooler floor 63 located on the floor 6 by supports 62. A pair of rails 66 are provided on the cooler floor 63. As with the cooling chamber 10, the cooler body 64 is provided with an inlet for supplying a cooling medium (not shown), a fan 67, and a motor 68 for operating the fan 67. As shown in FIG. 1, the cooler device 61 is connected to a portion of the cooling chamber 10 of the furnace body 1, and as with the heating chamber 9, that portion or a portion of the outer wall of the cooling chamber 10 has an opening 69 at its lower end. As with the opening 50 of the heating chamber 9, the opening 69 is closed by a movable partition door 70 which is raised to move a basket 21 from the cooling chamber 10 to another cooling chamber 65, allowing the former chamber 10 to communicate with the latter 65. Corresponding to the opening 69, another opening 71 is oppositely provided in the cooler device 61 for discharging a basket 21 from the cooler device 61. Similarly, this opening 71 is closed by a door 72, but is opened to discharge the basket 21 by raising the door 72. A table 73 for discharging the basket 21 is located outside the cooler device 61 in close proximity to the discharge opening 71 of the device 61. On the table 73 are provided with a pair of rails 74 and a cylinder 75. The cylinder 75 has a piston rod 76 with a pair of drawer means 77 and 78. When the piston rod 76 is moved forward, the drawer means 77 and 78 are brought down in directions indicated by arrows in FIG. 7 and travel to their respective draw positions in the chambers 65 and 10 without coming into contact with the baskets placed in those chambers. Then, both drawer means are erected in the chambers, and the piston rod 76 is retracted to cause the means 77 to draw out the basket in the cooler device 61 and the other means 78 to move the basket in the stay space 11*g* (of the cooling chamber 10) into the cooler device 61.

In the foregoing construction, a basket 21 containing a material to be treated is first placed on the rails 55 of the supply table 54. Then the door 53 is opened, the basket 21 is moved into the preheater device 42 by the pusher 58, and the door 53 is closed. In this device 42 the material in the basket 21 is heated to a predetermined temperature, such as 700° C. After it has been heated, the doors 51 and 53 are opened, and the basket 21 is moved from the device 42 onto the material area $20_1$ on the movable hearth 4 by means of the pusher 59. Simultaneously with the foregoing process, another basket 21 is similarly placed on the table 54 and moved into the preheater device 42 by the pusher 58. Then the doors 51 and 53 are both closed. In the heating chamber 9 the heating means 14 and the air circulator 15 are operated to heat the material in the basket 21 placed in the area $20_1$ or stay space 11*a* to a predetermined temperature, such as 750° C. Simultaneously the material placed in the preheater device 42 is heated as already mentioned. Then the doors 28 and 29 are raised or opened, and the hearth 4 is rotated three steps clockwise (or four steps counterclockwise) by the rotation mechanism 23 so that the area $20_1$ reaches the material-stay space 11*e*. The doors 28 and 29 are both closed, and the material thus located in the stay space 11*e* is cooled to a predetermined temperature, such as 700° C. Simultaneously the foregoing second basket 21 is placed on the material-placing area $20_4$ then located in the material-stay space 11*a*, and the material therein is heated to the predetermined temperature. After both cooling of the first material and heating of the second one have been completed, the doors 28 and 29 are opened, and the hearth 4 is rotated, e.g., the same steps as before clockwise so that the areas $\mathbf{20}_1$ and $\mathbf{20}_4$ move to the stay spaces 11*b* and 11*e*, respectively. The doors 28 and 29 are closed again. The material located in the stay space 11*b* is heated again to a predetermined temperature, such as 745° C., while that in the stay space 11*e* is cooled to 700° C. Simultaneously a still further basket 21 containing a material is placed on the area $\mathbf{20}_7$ then located in the stay space 11*a*, and that material is heated therein.

The material in the area $\mathbf{20}_1$ is further moved to and stayed in the spaces 11*f*, 11*c*, and 11*g* for further treatment. To sum up, therefore, the material is subjected to alternate treatments of heating and cooling by staying in the spaces 11*a*, 11*e*, 11*b*, 11*f*, 11*c*, and 11*g* in the order mentioned. In other words, the material is heated three times and cooled three times.

After the cooling of the material in the stay space 11*g* has been completed, the door 70 is opened and the basket 21 is moved onto the rails 66 of the cooler device 61 by the drawer means 78. Then the door 70 is closed, and the material thus located in the device 61 is gradually cooled to a predetermined temperature, such as 650° C. (at a rate of 60° C. or so per hour). The hearth 4 is rotated to move the area $\mathbf{20}_1$ then having no material to the stay space 11*d*. When the hearth 4 is rotated the next time, the area $\mathbf{20}_1$ is returned to the starting space 11*a*.

Figure 8:
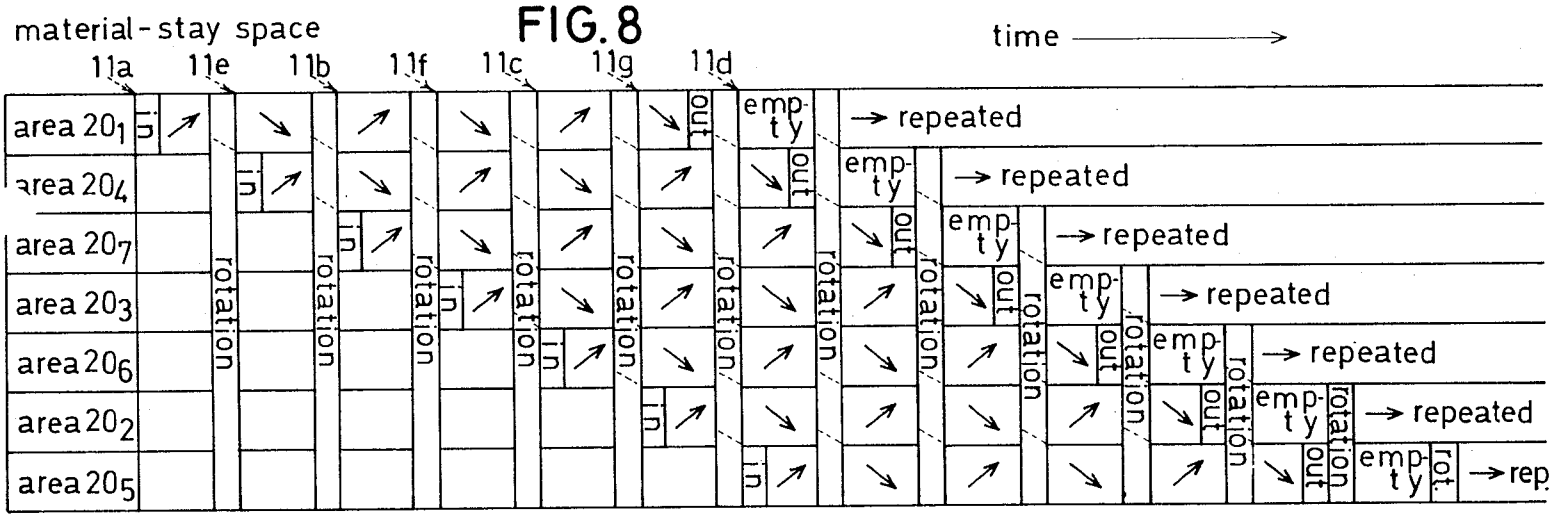
FIG. 8 is a table like a time chart, showing the processes of heat-treating a number of materials as against time.

In the foregoing process, a material loaded on one of the areas $\mathbf{20}_1$ to $\mathbf{20}_7$ through the preheater device 42 is treated in the same manner as those loaded on the other areas, i.e., subjected to alternate heating and cooling in the same number of times and the same temperatures as those materials. This process is illustrated in a table of FIG. 8, wherein the material area $\mathbf{20}_1$ is moved to and stopped at the stay spaces 11*a*, 11*e*, 11*b*, 11*f*, 11*c*, 11*g*, and 11*d* in the order mentioned; while thus circulating, the material (placed on the movable area $\mathbf{20}_1$ in the fixed space 11*a*) is subjected to alternate treatments of heatings indicated by arrows directed diagonally to the upper right of the table and coolings indicated by arrows to the lower right, and is taken out in the space 11*g*. It is to be seen from the table that the materials placed on the other areas are all treated in the same manner as that on the area $\mathbf{20}_1$. Thus the materials placed one after another on the supply table 54 are heat-treated in the order of placement and in the same manner, and removed onto the discharge table 73 through the cooler device 61.

Since the heat-treatment construction herein allows the materials to be loaded and unloaded on one side of the furnace body 1, the body may be located, e.g., in a corner of the plant so that the whole area of the plant is utilized with the maximum density.

Figure 9:
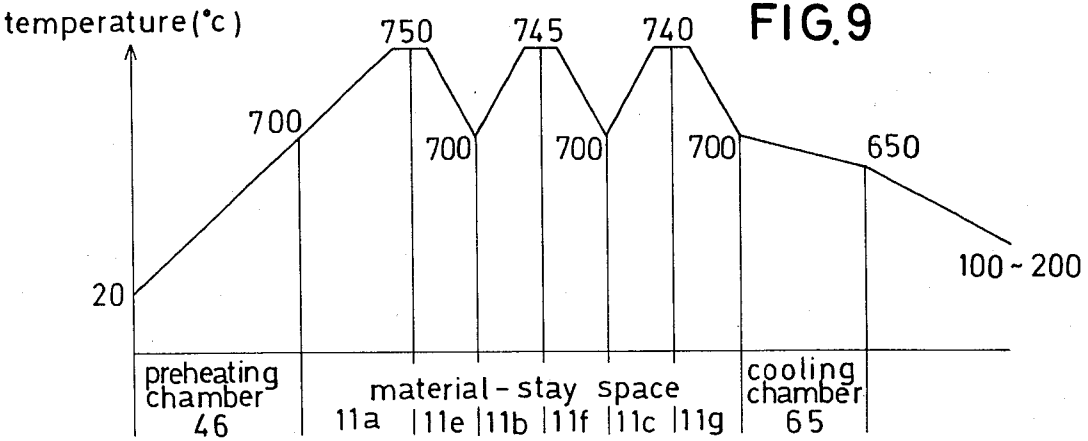
FIG. 9 is a graph showing variations which may be effected in the temperature of a material during heat treatment thereof by the system of FIG. 1.

FIG. 9 shows variations of the temperature of the material which are effected when the material is heat-treated as described before; it is seen that the material is heated to a temperature of 700° C. in the preheater device 42, subjected to alternate treatments of heating and cooling to the temperatures indicated, gradually cooled in the cooler device 61, and finally cooled to the normal temperatures on the discharge table (or at some other desired place). Such a particular process of heat treatment may be used to spheroidize metal, for example.

Although the hearth 4 has been described as being rotated intermittently in one direction (clockwise) and by equal angles or steps (3 steps), its rotational direction may be opposite as stated before or alternated with the other one so as to move the materials into stay spaces desired.

Also, there is no need to provide rails on the hearths to smoothly load or unload the baskets if the baskets themselves are provided with wheels to achieve the same purpose. Such a substitute would remove the necessity of opening the doors 28 and 29 to rotate the hearth 4 when no basket is moved from the heating chamber to the other chamber or vice versa, because the hearth 4 would have no projection to run against the doors in their lowered positions. By such a substitute, therfore, a transference of atmosphere might be minimized between the two chambers. Furthermore, if the material to be treated is relatively larger in size, it may be loaded into the furnace without a basket containing it.

In addition, the cooler device 61 and its associated material-discharge opening 69 may be located in combination with the stay space 11*d* instead of 11*g*. If such a modification is made, the material finally cooled in the space 11*g* is discharged after it has been moved into the stay space 11*d* by the next rotation of the hearth 4. In such a modification, materials to be treated are loaded into the system on one side thereof and unloaded therefrom on its other side. The system of such a construction may be adaptable for use in a line operation.

The process herein has been described as comprising three alternations of heating and cooling of each material, requiring seven stay spaces to be set. However, if a process of heating and cooling is to be carried out twice, five stay spaces (and five material areas ) are set according to the principle as stated before. Similarly, if four alternations are to be made, nine stay spaces (and nine material areas) are set. That is, the principle to determine the number of stay spaces and material areas required is represented by the general formula $(2_n+1)$ where n is the number of times of alternations of treatments to be made. The minimum number of the stay spaces to be set in each chamber 9 or 10 is n, and one remaining space may be made additionally to belong to either chamber.

Moreover, the materials to be treated may be circulated through the treatment space 5 not by making the hearth 4 movable, but by using any other suitable mechanism, such as a hanger type.

As many apparently widely different embodiments of this invention may be made without departing from the spirit and scope thereof, it is to be understood that the invention is not limited to the specific embodiments thereof except as defined in the appended claims.

What is claimed is:

1. A heat-treatment system comprising:

(a) a hollow furnace comprising a circular enclosure body having an exterior wall provided with an opening for supplying a material to be treated from exterior to interior and an opening for discharging the material to be treated from interior to exterior;

(b) moving means for circulating and moving the material to be treated along a predetermined locus within said furnace body;

(c) the interior of said furnace being provided with a plurality of stay spaces each having an area capable of positioning the material to be treated and equidistantly spaced from each other along said locus;

(d) the number of said stay spaces being a value obtained by adding 1 to a value twice the repetition frequency (N) of heating and cooling applied to the material to be treated, such that (2N+1) represents said value;

(e) a part of the space within said furnace body being partitioned by partioning walls so as to include consecutive stay spaces of at least the number (N) equal to said repetition frequency, to form heating areas;

(f) a part of the space within said furnace body being partitioned by partitioning walls so as to include consecutive stay spaces of at least the number (N) equal to said repetition frequency, to form cooling areas;

(g) the respective partitioning walls of said heating and cooling areas being positioned within said locus and provided with movable doors for permitting the material to be treated to move between the heating chamber and cooling chamber; and (h) moving means for alternately transferring the material between the heating chamber and cooling chamber, by a predetermined distance so that the place to which the material is transferred will always be a new stay space in each chamber not previously occupied during the transferring cycle between heating and cooling; and (i) said furnace having an enclosed means for receiving material to be preheated, projecting radially from the exterior wall thereof, said supply opening registering with the interior of said enclosed means and a removable closure means for said opening.

2. A construction according to claim 1 wherein said material-supply opening is disposed in combination with one of the endmost spaces of said stay spaces located in said heating chamber, while said material-discharge opening is disposed in combination with the endmost one of said stay spaces located is said cooling chamber which is adjacent to said endmost space in said heating chamber.

3. A construction according to claim 1 wherein said material-supply opening is disposed in combination with one of the endmost spaces of said stay spaces located in said heating chamber, while said material-discharge opening is disposed in combination with the endmost one of said stay spaces located in said cooling chamber which is not adjacent to said endmost space in said heating chamber.

4. A construction according to claim 1 wherein said stay spaces located through said treatment slpace are seven in number, and three of them are located in said heating chamber while the others are in said cooling chamber.

5. A hollow furnace accofding to claim 1 including an enclosed means for receiving material to be after-cooled projecting radially from said exterior wall, in said cooling area, said discharge opening registering with the interior of said second enclosed area and a removable closure for said discharge opening.

6. In a heat-treatment system including (a) a furnace body which is so shaped as to define an anular treatment space including a predetermined locus of circular travel of materials to be treated and is provided with an opening for supplying the materials into said treatment space and an opening for discharging the treated materials therefrom and (b) a means for circulating the materials through said treatment space in such a manner that the materials generate said predetermined travel locus and characterized in that (i) seven spaces are set in and through said treatment space and separated from one another at equal intervals and along said material-travel locus so as to stay the materials therein for treatment; (ii) said treatment space is divided into a heating chamber and a cooling chamber; (iii) three of said seven stay spaces are located in said heating chamber; (iv) four of said stay spaces are located in said cooling chamber; (v) said material-supply opening is disposed in combination with one of the endmost spaces of said three stay spaces located in said heating chamber; (vi) said material-discharge opening is disposed in combination with the endmost one of said four stay spaces located in said cooling chamber which is adjacent to said endmost space in said heating chamber; and (vii) said circulating means is adapted to move the materials intermittently through said treatment space so as to stay the materials in said spaces for treatment, a process for heat-treating metal or other kinds of materials in said above described furnace which comprises repeating the following steps (1) and (2) until the material is subjected to a sequence of heating and cooling treatments three times:

(1) (I) placing a material through said supply opening into said stay space located in combination therewith and heating the material;

(II) heating the materials moved into and stopped at the other stay spaces in said heating chamber;

(III) cooling the material moved into and stopped at said stay space located in combination with said discharge opening and discharging the cooled material from said treatment space; and (IV) cooling the materials moved into and stopped at the other stay spaces in said cooling chamber, (2) moving the materials in said stay spaces into the third one beyond each stay space in the same direction so that the materials in said stay spaces located in said heating chamber travel into said stay spaces located in said cooling chamber, while the materials in the latter stay spaces travel into the former stay spaces, whereby the material is alternately heated and cooled three times.

* * * * *